US007926587B2

(12) United States Patent
Gieseke

(10) Patent No.: US 7,926,587 B2
(45) Date of Patent: Apr. 19, 2011

(54) EXPLOSIVE WATER JET WITH PRECURSOR BUBBLE

(75) Inventor: Thomas J. Gieseke, Newport, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 516 days.

(21) Appl. No.: 12/110,703

(22) Filed: Apr. 28, 2008

(65) Prior Publication Data

US 2009/0031873 A1 Feb. 5, 2009

Related U.S. Application Data

(60) Provisional application No. 60/963,201, filed on Jul. 20, 2007.

(51) Int. Cl.
*E21B 7/04* (2006.01)
*E02F 3/00* (2006.01)

(52) U.S. Cl. ..... 175/14; 37/344

(58) Field of Classification Search ..... 37/307, 37/314, 342, 344; 175/14, 15, 17, 67, 93, 175/424; 239/101, 601, 602, 127.3; 299/17; 431/158

See application file for complete search history.

(56) References Cited

U.S. PATENT DOCUMENTS 3,182,734 A * 5/1965 Scott ..... 175/14
3,539,104 A * 11/1970 Cooley ..... 239/101
3,620,313 A * 11/1971 Elmore et al. ..... 175/14
4,073,351 A * 2/1978 Baum ..... 175/14

* cited by examiner

*Primary Examiner* — Robert E Pezzuto
(74) *Attorney, Agent, or Firm* — James M. Kasischke; Michael P. Stanley; Jean-Paul A. Nasser

(57) ABSTRACT

A water jet assembly and method of use is provided comprising a tank with cutting fluid, fuel and oxidizer lines, and a tank discharge lines. In operation, the tank is filled with oxidizer; the oxidizer line is closed and cutting fluid is supplied compressing the oxidizer. When the fluid reaches a level, the fluid line is closed and fuel is injected. A spark generator ignites the fuel/oxidizer mixture thereby raising the tank pressure. As the pressure rises, a low pressure valve simultaneously closes at a prescribed level. The vent line and a discharge to a nozzle are opened thereby, forming a gas bubble. When the bubble reaches a desired size and pressure drops below a level, the vent closes, allowing combustion expansion to force fluid through the nozzle to form a cutting jet.

3 Claims, 9 Drawing Sheets

EXPLOSIVE WATER JET WITH PRECURSOR BUBBLE

This application claims the benefit of U.S. Provisional Patent Application Ser. No. 60/963,201 filed on Jul. 20, 2007 and entitled "Explosive Water Jet with Precursor Bubble" by the inventor, Thomas J. Gieseke.

STATEMENT OF GOVERNMENT INTEREST

The invention described herein may be manufactured and used by or for the Government of the United States of America for Governmental purposes without the payment of any royalties thereon or therefore.

CROSS REFERENCE TO OTHER PATENT APPLICATIONS

None.

BACKGROUND OF THE INVENTION (1) Field of the Invention

The present invention relates to an assembly and a method of use for producing a high velocity water jet in a deep-water environment where depth pressure would typically inhibit the formation of a supercavitation bubble.

(2) Description of the Prior Art

High velocity jets are commonly used in industrial systems for cutting operations. For example: pressures of 380 Mpa (50,000 pounds per square inch), generated with specialized hydraulic pumps, are used to produce small diameter fluid jets with velocities approaching 800 meters per second. These systems are designed for precision and continuous cutting. As such, diameters of the fluid jets are typically very small (no greater than one millimeter).

Jet pulses of this size can only penetrate a short distance (typically one meter) in the water. Power consumption for significantly larger jets becomes prohibitive if sustained operation is required.

The water jet system described in U.S. Pat. No. 6,868,790 (Gieseke et al.) is designed to overcome the jet formation inhibiting effects of water as a surrounding medium. The system and method of use of the cited reference utilizes a supercavity formed by an impulsively-created jet as a jet front propagates through the medium. At a significant depth (greater than one hundred meters) and under a high ambient pressure at the depth, the cavitation bubble, that would otherwise form at the jet front, is suppressed. For use in deep water drilling applications, a need therefore exists for forming the cavitation bubble that overcomes the jet formation inhibiting effects of water as a surrounding medium.

SUMMARY OF THE INVENTION

Accordingly, it is a general purpose and primary object of the present invention to provide an assembly and method of use for drilling in deep water applications.

It is a further object of the present invention to provide an assembly and method of use for creating a gas bubble at the water jet discharge nozzle through which high velocity water is expelled as a cutting system that overcomes the jet formation inhibiting effects of water as a surrounding medium.

To attain the objects described above, the present invention features an assembly and method of use for producing a pulsed jet. The assembly generally comprises a tank, feed lines for water an oxidizer line, a fuel line, a spark generator, discharge lines and control valves.

In operation, the tank is purged using a gaseous oxidizer. Any residual combustion gas and liquid is forced out of the tank through discharge valves and a nozzle. The discharge valves are then closed and the tank is filled with oxidizer. The oxidizer control valve is then closed and water or other cutting fluid is injected into the tank, thereby compressing the oxidizer within the tank.

When the cutting fluid attains a desired level in the tank, the control valve is closed and fuel is injected into the compressed oxidizer trapped above the cutting fluid. A spark generator ignites the fuel/air mixture; thereby, raising the pressure in the tank. As the pressure rises in the tank, a low-pressure control valve closes at a prescribed level. Simultaneously, a gas vent line is opened, as is a high-pressure discharge valve. Combustion gas is then free to discharge into the water medium through the discharge nozzle, thereby, forming a gas bubble at the nozzle exit.

When the gas bubble reaches a desired size and the pressure in the tank drops below a desired level, the gas vent line is closed, and the high pressure discharge valve opens to allow expansion of the combination gas. The gas forces the cutting fluid through the discharge nozzle.

The discharged cutting fluid forms a cutting jet. The presence of the gas bubble allows the jet to retain coherence as the water jet traverses the space between the nozzle and a cutting surface. After the cutting fluid has been expended, the remaining gas discharges through the nozzle, completing the cutting cycle.

Generally, the proposed water jet assembly and method of use overcomes difficulties with traditionally-used steady cutting jets and the pulsed difficulties of the jet described in U.S. Pat. No. 6,868,790 (incorporated herein by reference) by venting combustion gases immediately prior to the water jet in order to eliminate water resistance.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein like reference numerals and symbols designate identical or corresponding parts throughout the several views and wherein.

DETAILED DESCRIPTION OF THE INVENTION

Figure 1:
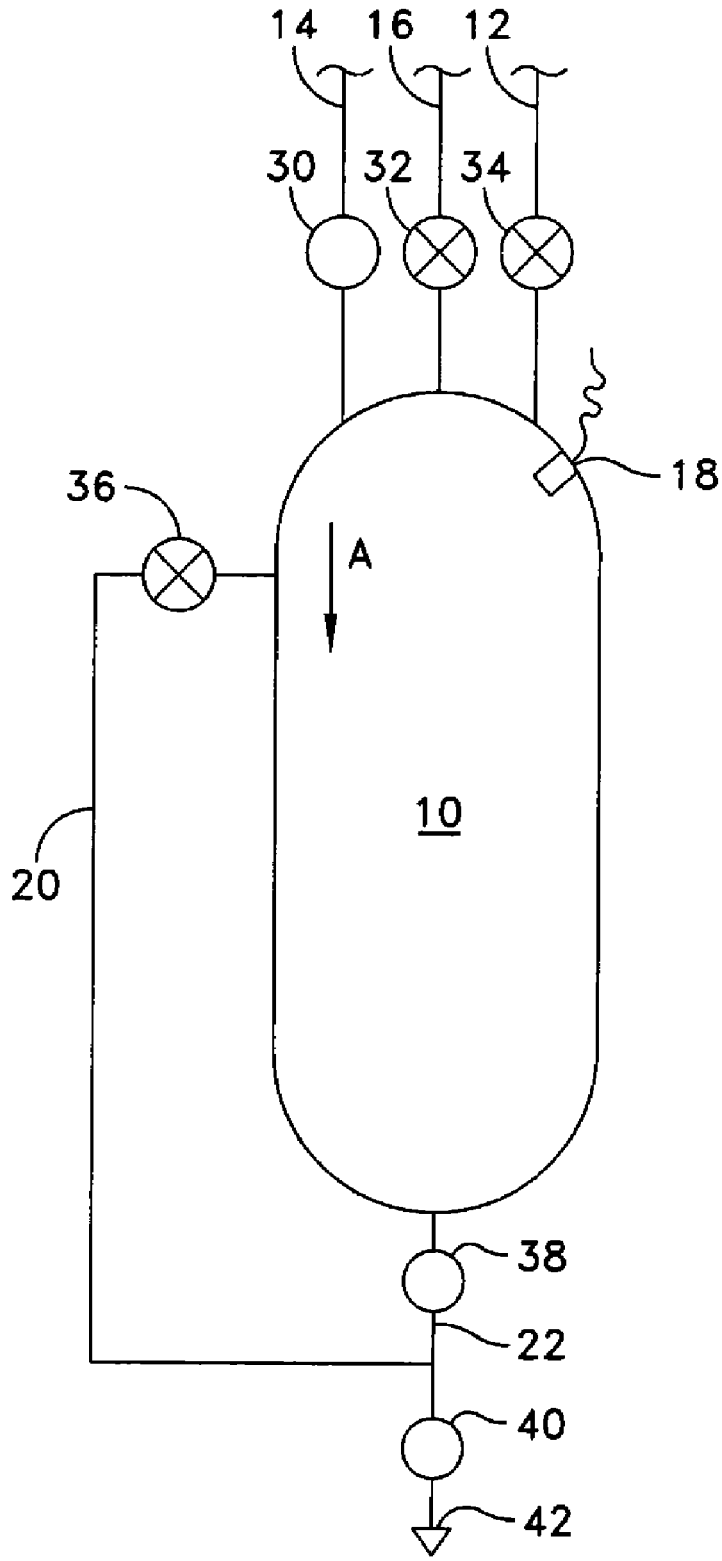
FIG. 1 depicts a schematic view of a pulsed jet generating system according to the present invention with the system in a purging operation.

FIG. 1 through FIG. 8 illustrate the operation of the water jet system of the present invention. The system consists of a tank 10, a water feed line 12, an oxidizer line 14, a fuel line 16, a spark generator 18, a gas vent 20, a discharge line 22 and control valves 30, 32, 34, 36, 38, 40.

In operation, the tank 10 is purged by the oxidizer line 14 using a gaseous oxidizer—such as air. As shown in FIG. 1, any residual combustion gas and liquid is forced out of the tank 10 in direction "A" through the discharge valves 38, 40 and a nozzle 42 by using the oxidizer supplied by the oxidizer line 14 (See Table 1 for valve sequencing).

Figure 2:
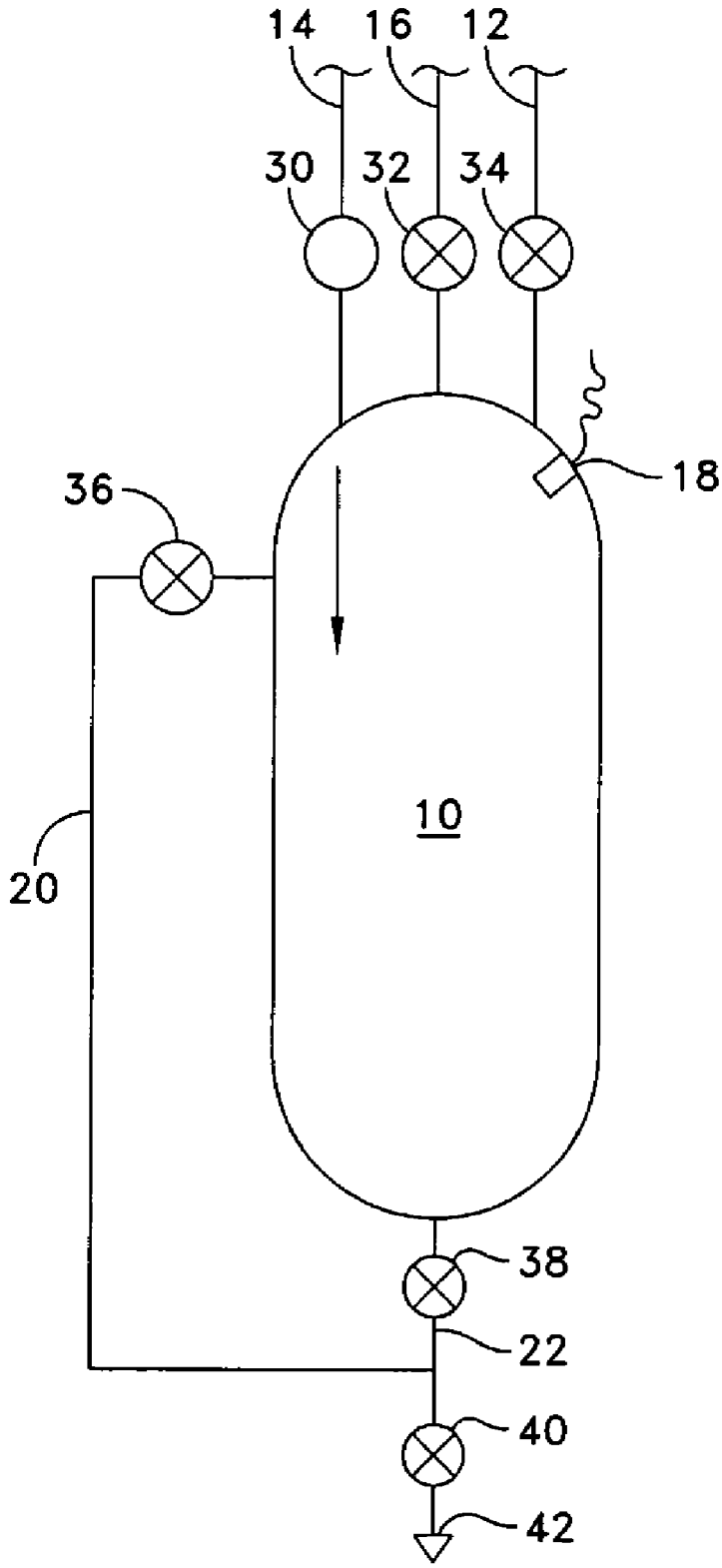
FIG. 2 depicts a schematic view of the pulsed jet generating system with the system in an oxidizer filling operation.
Figure 3:
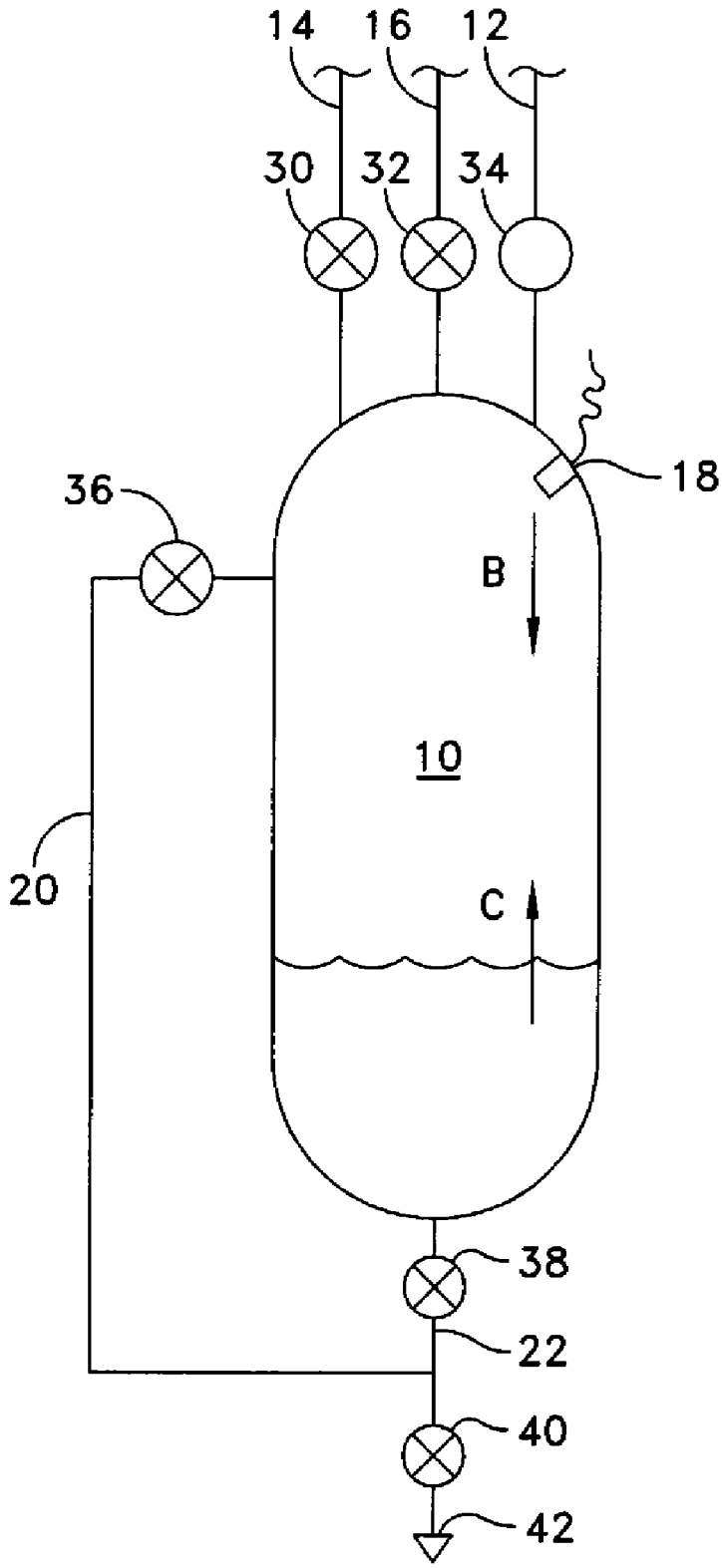
FIG. 3 depicts a schematic view of the pulsed jet generating system with the system in a cutting fluid filling operation.

The control valves 38, 40 are then closed and the tank 10 is filled with oxidizer (See FIG. 2). The control valve 30 is then closed and water by the water feed line 12 (or other cutting fluid) is supplied in direction "B" into the tank 10 by the opening of control valve 34, thereby compressing the oxidizer within the tank (See FIG. 3).

Figure 4:
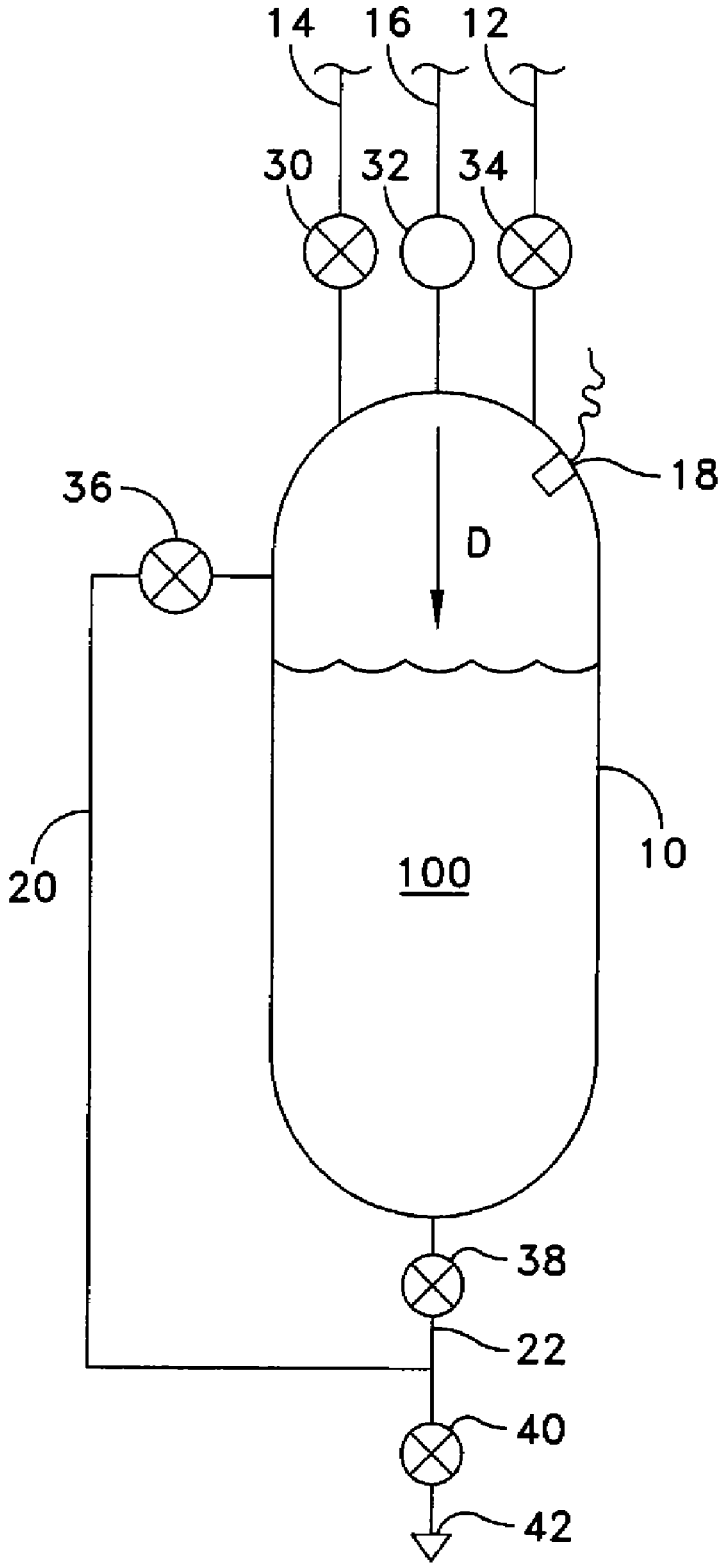
FIG. 4 depicts a schematic view of the pulsed jet generating system with the system in a fuel injection operation.

When the cutting fluid attains a desired level 100 in the tank 10 (Direction "C"), the control valve 34 is closed and the control valve 32 in the fuel line 16 is opened and fuel is injected in Direction "D" to the compressed oxidizer trapped above the cutting fluid (See FIG. 4).

Figure 5:
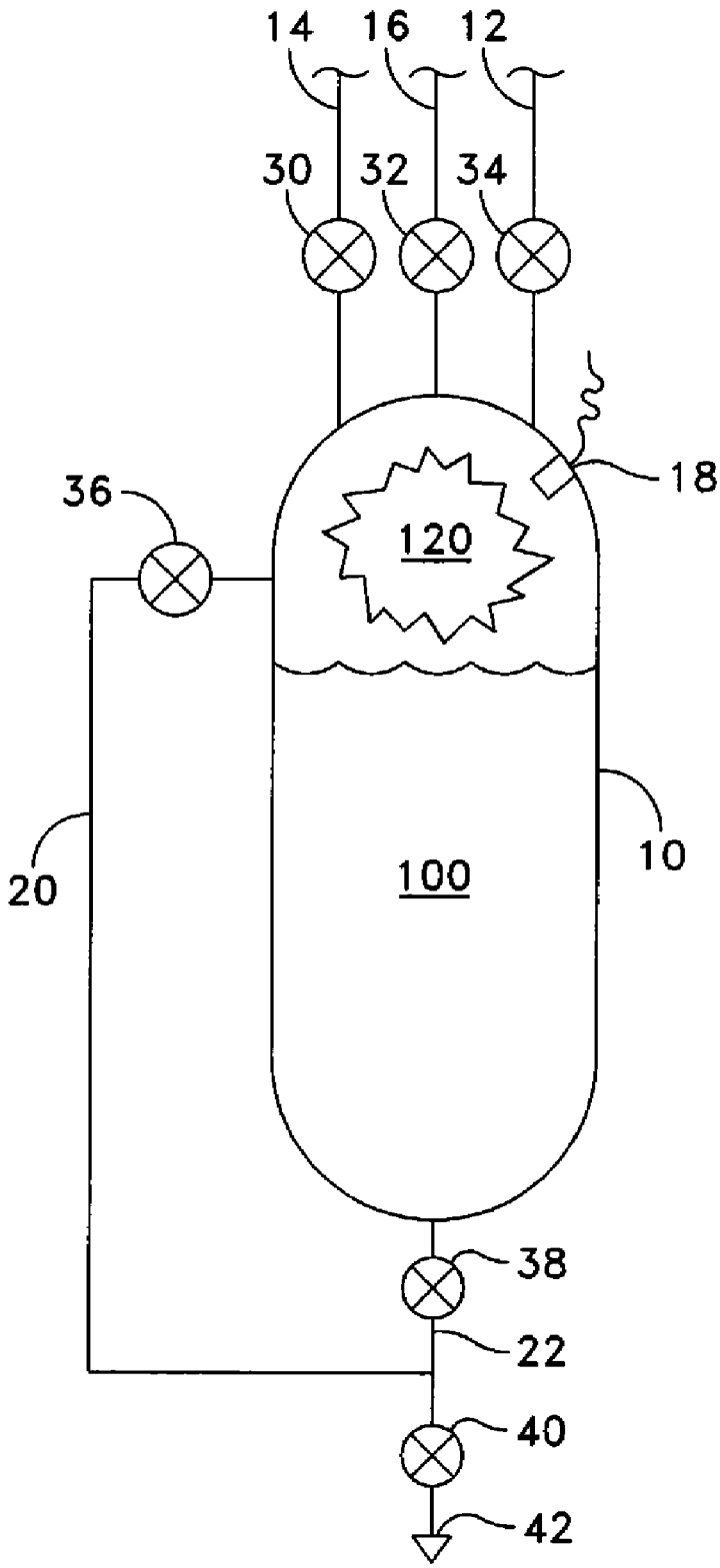
FIG. 5 depicts a schematic view of the pulsed jet generating system with the system in an ignition operation.
Figure 6:
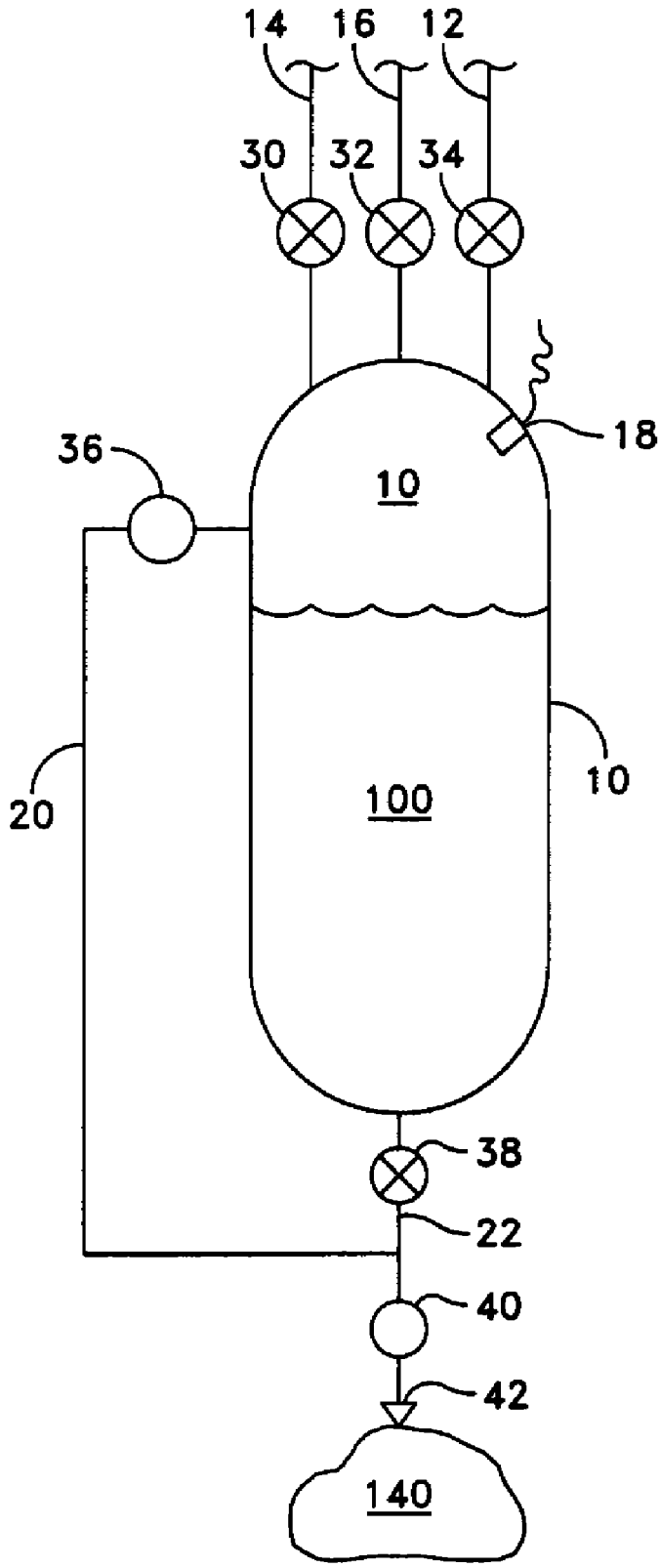
FIG. 6 depicts a schematic view of the pulsed jet generating system according with the system in a gas-venting operation.

The spark generator 18 ignites the fuel/oxidizer mixture for an explosive ignition 120, thereby, raising the pressure in the tank 10 (See FIG. 5). As the pressure rises in the tank 10, the control valve 32 closes at a prescribed level (approximately 50 pounds per square inch over ambient pressure). Simultaneously, the control valve 36 of the gas vent line 20 is opened, as is the high-pressure discharge control valve 40. Combustion gas is then free to discharge into the water medium through the discharge nozzle 42, forming a gas bubble 140 at the nozzle exit (See FIG. 6).

Figure 7:
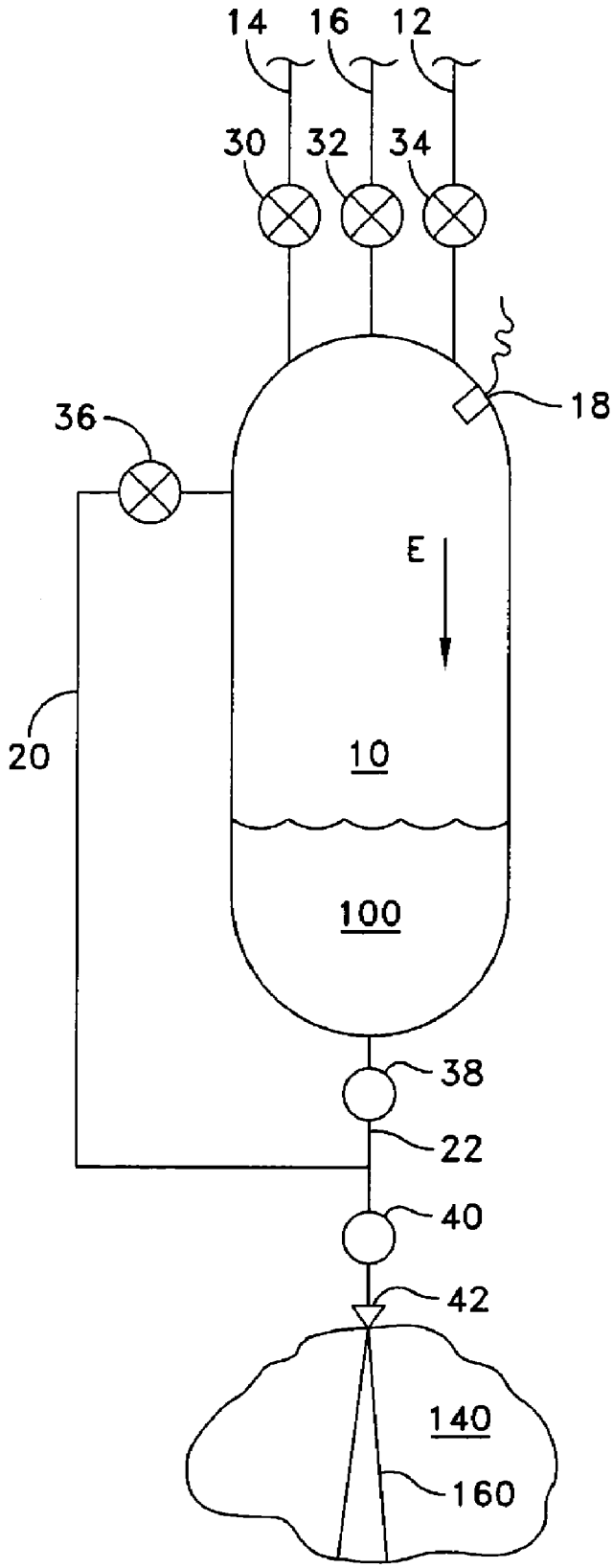
FIG. 7 depicts a schematic view of the pulsed jet generating system with the system in a cutting jet formation.
Figure 8:
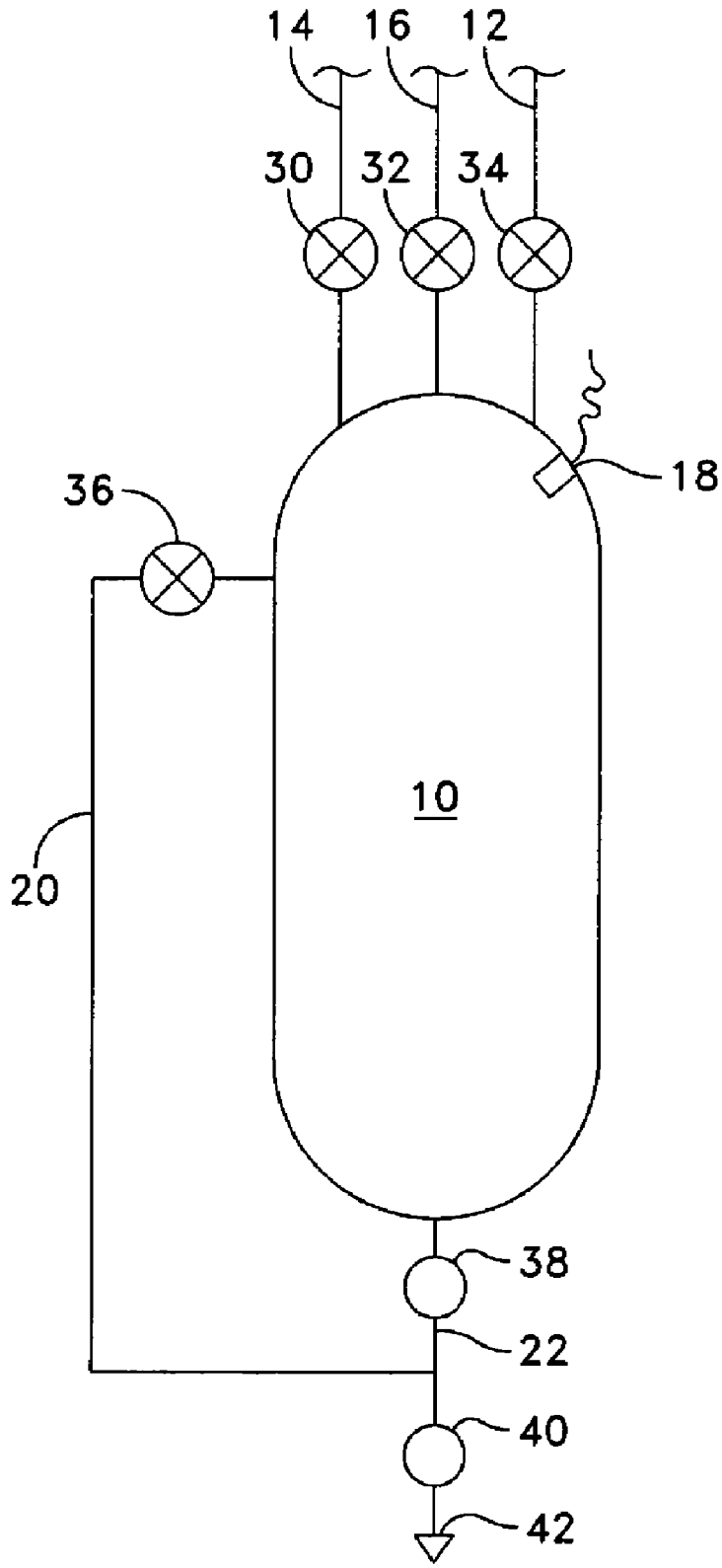
FIG. 8 depicts a schematic view of the pulsed jet generating system with the system in a tank-venting operation.

When the gas bubble 140 reaches a desired size and the pressure in the tank 10 drops below a desired level, the control valve 36 closes, and the control valve 40 remains open to allow expansion of the combination gas (See FIG. 7). The expanding gas forces the cutting fluid 100 out of the tank 10 in Direction "E" through the discharge nozzle 42.

The discharged cutting fluid 100 forms a cutting jet 160. The presence of the gas bubble 140 allows the cutting jet 160 to retain coherence as the water of the cutting jet traverses a space between the nozzle 42 and a cutting surface. After the cutting fluid 100 has been expended, the remaining combustion gas discharges through the nozzle 42, completing the cycle (See FIG. 8). To produce a pulsed cutting jet, the cycle is repeated in succession.

Figure 9:
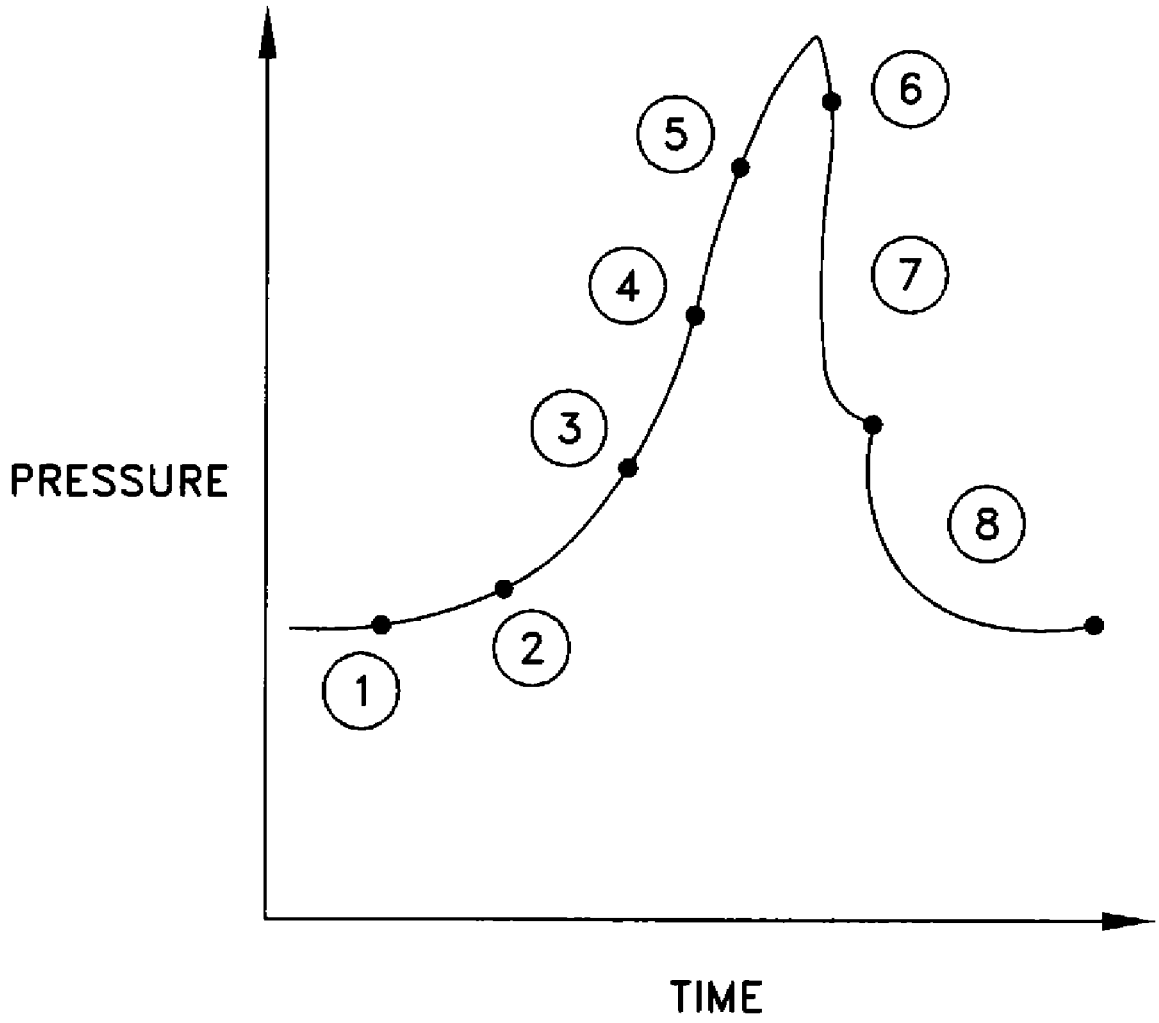
FIG. 9 is a graph depicting tank pressures as a function of time and operating steps.

Pressures realized in the tank 10 over time during the cycle are shown in FIG. 9. The labeled phases of operation are: 1) purging; 2) oxidizer injection; 3) compression; 4) fuel injection; 5) combustion; 6) gas venting; 7) cutting jet formation; and 8) tank venting.

The valves used in the proposed system may be controlled via servo systems or through the use of pressure activation. Table 1 matches the valve cycle phase and operation state ("x" denotes a closed state and "o" denotes an open state).

TABLE 1

Valve Sequencing

| Phase | Valve: Oxidizer in | Fuel in | Water/Cutting Fluid in | Gas vent | Upper Discharge | Lower Discharge | Start Pressure* | End Pressure* |
|---|---|---|---|---|---|---|---|---|
| Purging | ○ | X | X | X | ○ | ○ | 0 | 0 |
| Oxidizer injection | ○ | X | X | X | X | X | 0 | 1 |
| Cutting fluid supply/Compression | X | X | ○ | X | X | X | 1 | 10 |
| Fuel injection | X | ○ | X | X | X | X | 10 | 10 |
| Combustion | X | X | X | X | X | X | 10 | 50 |
| Gas venting | X | X | X | ○ | X | ○ | 50 | 40 |
| Cutting jet formation | X | X | X | X | ○ | ○ | 40 | 10 |
| Tank venting | X | X | X | X | ○ | ○ | 10 | 0 |

Actuation pressures are dimensionless, relative, differential, and approximate.

The foregoing description of the preferred embodiments of the invention has been presented for purposes of illustration and description only. It is not intended to be exhaustive nor to limit the invention to the precise form disclosed; and obviously many modifications and variations are possible in light of the above teaching. Such modifications and variations that may be apparent to a person skilled in the art are intended to be included within the scope of this invention as defined by the accompanying claims.

What is claimed is:

1. A method of generating a pulsed cutting jet in a water medium, said method comprising the steps of:

filling a tank with oxidizer to a predetermined level;

filling the tank with a cutting fluid to a predetermined level;

compressing the oxidizer and the cutting fluid;

injecting fuel into the tank adjacent to the cutting fluid;

igniting the fuel to generate a combustion gas within the tank thereby creating a pressure within the tank;

venting the tank;

discharging with said venting step by the created pressure the combustion gas from a nozzle in fluid communication with the tank to the water medium;

discharging by the created pressure a portion of the cutting fluid from the nozzle;

forming a cutting jet from the cutting fluid in the water medium;

removing remaining of the combustion gas from the chamber; and repeating to a predetermined amount and subsequent to the removal step, the steps of said method thereby increasing the force of the formed cutting jet of said forming step to be the pulsed cutting jet.

2. The method in accordance with claim 1, said method further comprising a step of purging the tank prior to said chamber filling step.

3. An assembly for producing a pulsed cutting jet in a water medium, said assembly comprising:

a tank;

a feed line for cutting fluid in fluid communication with said tank and capable of fluid communication with a cutting fluid source;

a second feed line for oxidizer in fluid communication with said tank and capable of fluid communication with an oxidizer source;

a third feed line for fuel in fluid communication with said tank and capable of fluid communication with a fuel source;

a first valve positioned at said tank, said first valve capable of regulating the cutting fluid entering said tank;

a second valve positioned at said tank, said second valve capable of regulating the fuel entering said tank;

a third valve positioned at said tank, said third valve capable of venting said tank above any cutting fluid level within said tank to a vent line in fluid connection with said tank;

a discharge line in fluid communication with said tank;

a fourth valve positioned on said discharge line between said tank and a connection of said vent line to said discharge line;

an igniter within said tank capable of forming a pressurized combustion gas within said tank by igniting the fuel within said tank thereby pressurizing the fluid;

a fifth valve positioned on a side of the vent-line connection opposite said fourth valve; and a nozzle adjacent to said fifth valve and on a side opposite the vent line connection in fluid communication with said tank, with said nozzle sized as an egress to the pressurized fluid such that the pressurized fluid emitting from said nozzle forms a cutting jet downstream of said egress and within the undersea medium.

* * * * *